United States Patent [19]

Kosson

[11] Patent Number: 4,470,759

[45] Date of Patent: Sep. 11, 1984

[54] CAPILLARY CHECK VALVE PUMP AND METHOD

[75] Inventor: Robert L. Kosson, Massapequa, N.Y.

[73] Assignee: Grumman Aerospace Corporation, Bethpage, N.Y.

[21] Appl. No.: 384,534

[22] Filed: Jun. 3, 1982

[51] Int. Cl.[3] ..... F04B 19/24; F04F 1/18

[52] U.S. Cl. ..... 417/208; 165/104.14; 165/104.24; 237/64

[58] Field of Search ..... 165/104.22, 104.24; 417/207, 208, 209; 237/60, 61, 62, 63, 64; 122/366

[56] References Cited

U.S. PATENT DOCUMENTS 3,898,017 8/1975 Mandroian ..... 417/209 X 3,929,305 12/1975 Sabol ..... 417/209 X

*Primary Examiner*—Albert W. Davis, Jr.

*Attorney, Agent, or Firm*—Richard G. Geib

[57] ABSTRACT

A method for thermally pumping volatile liquids and a pump for use therewith. The pump has an inlet liquid cooled pump chamber having therein a porous inlet membrane and a porous exit membrane defining between them a pump volume. The membranes are permeable to the liquid phase of the fluid being pumped but, when saturated with liquid, are not permeable to the vapor phase of the fluid. A passive check valve system permitting the passage of liquid but preventing the passage of vapor therethrough is thus formed by the membranes. A baffle plate with a heater located in a concavity therein is positioned in the pump volume adjacent the inlet membrane. The pump output is connected to the inlet of a suitable heat transfer system preferably of the heat-pipe type. With the pump filled with liquid, pumping is initiated by turning on the heater, forming a vapor bubble in the liquid in the pump volume. A heat input is continued until the vapor bubble has grown to a size sufficient to expel most of the liquid in the pump volume. The heating pulse is then terminated. Condensation of the vapor bubble then occurs and the resulting drop in pressure causes liquid to be drawn into the pump volume, setting the stage for the entire cycle to repeat.

6 Claims, 2 Drawing Figures

CAPILLARY CHECK VALVE PUMP AND METHOD

BACKGROUND OF THE INVENTION

1. Field of the Invention

This invention relates to liquid pumping means for thermal management systems and, in particular, to a method of thermally pumping a volatile fluid and to a capillary check valve pump used in the method.

2. Description of the Prior Art

In current space activities, the very large, long-life space systems presently being planned are based on the large lift capabilities of the United States Space Shuttle. These large satellites and other space projects will require thermal management systems with multikilowatt capacity capable of collecting and transporting heat from various subsystems to heat rejection radiators. Transport distances are expected to be on the order of 10 to 30 meters. Current technology for large thermal transport systems is based on circulating liquid loops. These tend to be heavy and vulnerable to micrometeroid puncture, have relatively low thermal performance (film coefficients), and require significant amounts of pump power. As current demonstrated pump life is only 2½ years, the pumps and the required valves also lower system reliability. Many problems inherent in thermal systems using a circulating liquid can be alleviated by using a capillary-pumped two-phase circulating system. Liquid delivered to the mounting panels on which heat generating equipment is fixed would pick up heat by evaporation. The vapor would be delivered to heat sinks, yielding heat by condensation. Compared to circulating liquid systems, mass flow rates and liquid line sizes would be reduced, film coefficients would be higher, and pump power would be reduced.

Although a two-phase wick-type heat transfer system using heat pipe principles avoids the requirement for mechanical pumps with their attendant disadvantages because of their moving parts and the like, it is sometimes desirable to provide more precise thermal control over the system and also to improve its heat transport capacity. In addition, in some two-phase systems under stated circumstances, it is advantageous to keep certain fluid lines open continuously if such can be arranged without the use of a solenoid valve. The pumping method and the capillary check valve pump of the present invention serves these desired functions.

In the prior art, apparatus with no moving parts in which a liquid is heated to produce a vapor that can be used for pumping functions is disclosured by E. A. Weaver (U.S. Pat. No. 1,847,286); S. H. Raskin (U.S. Pat. No. 2,763,246); B. D. Power (U.S. Pat. No. 3,686,474); B. D. Power et al. (U.S. Pat. No. 3,781,518); H-L. von Cube (U.S. Pat. No. 3,817,321); and J. F. Pollock et al (U.S. Pat. No. 3,943,330). Weaver, Power, Power et al., and Pollock et al. use the capillary action of a porous membrane as the liquid feed means in their pumps. Vaporization is enhanced by heating the membrane, either by the Joule Effect, or in the case of Weaver, by a heat input into the vaporization surface of the membrane. Raskin discloses a device which is not a pump per se but a construction which uses a heat input into a column of liquid to generate bubbles therein, which bubbles are conveyed to an outlet such that intermittent puffs of steam are produced. Unlike the present invention in which a liquid is pumped, the output of the aforementioned references except von Cube, is a vapor.

In von Cube, a "bubble pump" using a heat input from electronic equipment cooled thereby is used to circulate the liquid employed in cooling. Although means for pumping a liquid is disclosed by von Cube, the capillary means for pumping and flow control of the present invention is not used in his apparatus. There are also showings in L. V. Lucia (U.S. Pat. No. 1,922,546); C. J. Van Hook (U.S. Pat. No. 2,755,792); and J. D. Buchanan et al. (U.S. Pat. No. 3,065,712) of pumping means in which a vapor is used to pump a liquid. In those prior art showings, a liquid in a chamber is heated to produce a vapor that pumps liquid from the chamber. Unlike the present invention which teaches a liquid pumping method and a pumping means with no moving parts for use therewith, the latter-referenced references teach means which require the use of mechanical check valves for their operation.

SUMMARY OF THE INVENTION

This invention is a method for thermally pumping volatile liquids and a capillary check valve pump used in the method which is particularly suitable for use in a two-phase wick-type heat transfer loop. It is believed that an understanding of the method will be obtained from the following description of the pump used therewith. The pump has a pump chamber which is cooled by inlet liquid. The pump chamber has an inlet and an outlet. Across the chamber at the inlet is a porous membrane and a second porous membrane is positioned across the chamber at the outlet such that a pump volume is formed between the two membranes. The membranes have fine capillary pores, and when saturated with liquid are permeable to only the liquid phase of the fluid being pumped. Spaced inside the pump volume in proximity to the inlet membrane is a baffle plate having at its center a concavity facing the inlet membrane. The baffle plate is coextensive with the membrane except that the edges of the plate are spaced from the wall of the chamber to permit the passage of fluid therearound. Controllable heating means are provided in the baffle plate concavity. In the initial condition, at least the pump volume is filled with the liquid phase of the working fluid of the heat transfer loop. To initiate pumping, the heating means is turned on, heating the liquid in the concavity to form a vapor bubble centered therein and raising the pressure within the pump volume. The baffle plate holds the vapor bubble against the inlet membrane. A backflow of vapor through the inlet membrane is prevented by the capillary pressure rise capability of the membrane due to the small size of its pores. When the pressure within the pump volume exceeds the pressure downstream of the pump, liquid flows through the exit membrane. A heat input is continued until the vapor bubble has expelled most of the liquid from the pump volume. Most of the liquid expelled from the pump is captured by wicking associated with a cold plate in the heat transfer system with which the pump is used. Because there is a separation between the cold plate wicking and the exit membrane, the region downstream of that membrane fills with vapor when the vapor bubble in the pump volume begins to condense at the end of the heating pulse. Because the exit membrane has sufficient capillary capability, a backflow of vapor into the pump volume is prevented. As the vapor bubble continues to condense, the pressure within the the pump falls below inlet pressure and liquid begins to flow through the inlet membrane. When the bubble is completely condensed, the pump volume will again be filled with liquid and the heating pulse can be initiated to repeat the cycle.

It is thus a principal object of the invention to provide a method for thermally pumping a volatile liquid and to provide a capillary check valve pump employing the method which is useable with capillary two-phase thermal control system, which pump provides variable capacity pump performance with no moving parts and which produces higher pressure differences than are normally provided by heat pipe capillary systems.

It is another object of the invention to provide a method for thermally pumping a volatile liquid and to provide a capillary check valve pump with no moving parts useable in the method which pump has an easily variable flow rate and which permits a reverse flow of liquid.

It is a further object of the invention to provide a capillary check valve pump and pumping method in which the pumping action is a result of a periodic heat input into the pump, the interval between periods of heat input being easily varied to readily control the output of the pump.

Yet another object of the invention is to provide a capillary check valve pump and pumping method which are particularly suitable for use in space vehicle thermal control systems.

Other objects and advantages of the present invention will become apparent from the figures and specifications which follow.

DESCRIPTION OF THE DRAWINGS

For the purpose of illustrating the invention, there is shown in the drawings the form which is presently preferred; it should be understood, however, that the invention is not necessarily limited to the precise instrumentalities and arrangements here shown.

DESCRIPTION OF THE PREFERRED EMBODIMENT

Figure 1:
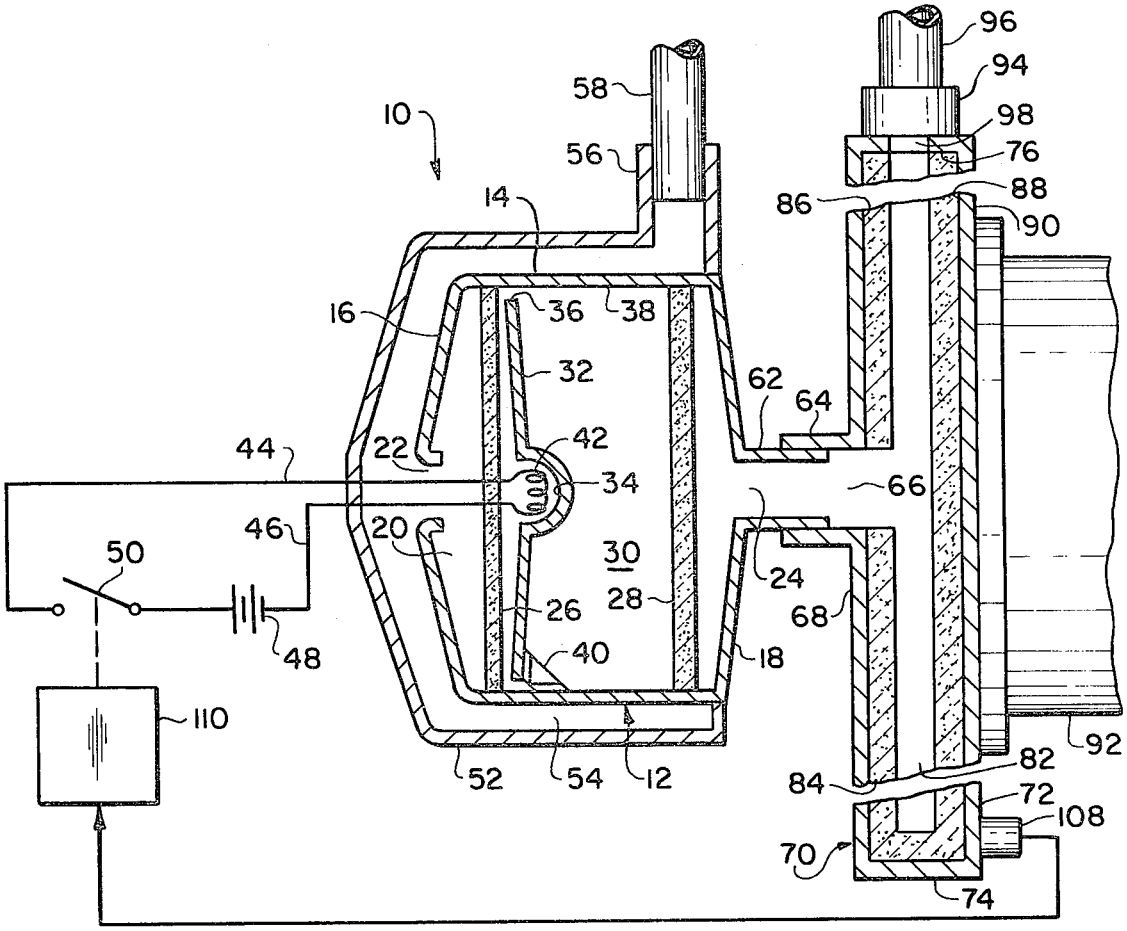
FIG. 1 is a side elevation in section of the capillary check valve pump of the invention showing, in fragmentary section, a part of a cold plate of an associated thermal control system.

With reference now to FIG. 1 of the drawings, a capillary check valve pump 10 particularly suitable for use in the method of the invention has a pump housing or body 12 having a side wall 14, a first end wall 16, and a second end wall 18 defining therein a pressure resistant pump chamber 20. The housing can be cylindrical as shown or have any other suitable configuration. Chamber 20 has an inlet port or opening 22 in the first end wall and an exit port or opening 24 in the second end wall. A porous inlet membrane 26 is located across the pump chamber at the inlet end thereof and a porous exit membrane 28 is located across the chamber at the exit 24 end thereof such that a pump volume 30 is formed between the membranes. Any suitable porous material can be used for the membranes provided the pores are very small. As is known, the pore size will be a function of the working fluid used but will generally average approximately 10–25 microns in size, and the material selected has a sufficient capillary pressure rise capability with respect to the working fluid of the system to prevent vapor flow through the membrane. The membranes, when saturated with liquid, thus are permeable to only the liquid phase of the volatile fluid being pumped. Spaced inside the pump volume 30 in proximity to the inlet membrane 26 is a circular baffle plate 32 having a centrally located concavity 34 facing the inlet membrane. The baffle plate 32 is coextensive with the inlet membrane except that the peripheral edges 36 of the plate are spaced from the inside surface 38 of the side wall 14 of the pump chamber to allow for the passage of fluid therearound. A plurality of radially extending brackets 40 fastened around the edge portion of the baffle plate mounts the plate on surface 38 of the chamber. Suitably mounted in conavity 34 is a controllable heating means preferably an electrical resistance-type immersion heater 42 which is in circuit by means of electrical wires 44, 46 with a remotely located power supply 48 and an on-off switch 50. Cooling means comprising a jacket 52 having passage 54 through which inlet liquid is circulated is provided to cool the side wall 14 and the first end wall 16 of the pump. Fluid is admitted into the jacket 52 through an inlet fitting 56 which is connected to a supply of liquid such as the liquid line 58 of the heat transfer system 60 to be described and, after circulating through passage 54, enters the pump chamber 20 through inlet opening 22. Liquid delivered from the pump is expelled out of exit port 24 in an exit fitting 62 in the second end wall 18 of the pump.

Figure 2:
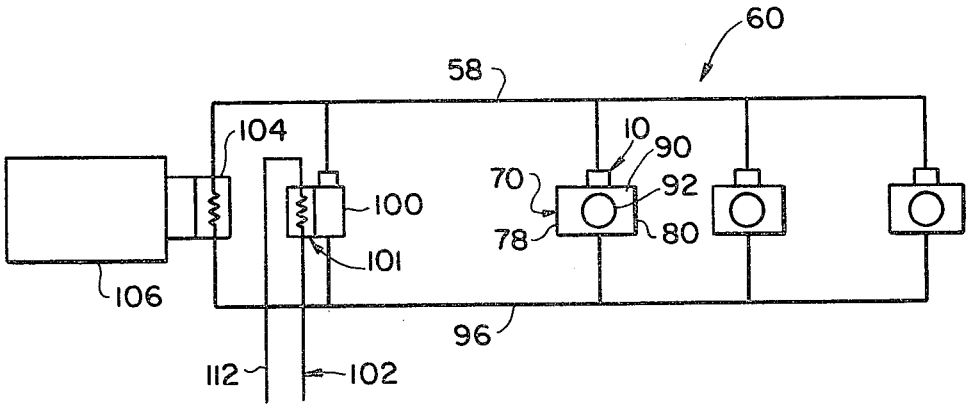
FIG. 2 is a diagrammatic representation of a thermal control system incorporating the capillary check valve pump of the invention.

Pump 10 is suitable for use with any appropriate heat management system such as a wick-type two-phase heat transfer loop or system 60 illustrated in FIG. 2. As shown in FIG. 1, the outlet fitting 62 of pump 10 can be connected to the inlet fitting 64 of the inlet 66 in the wall 68 of a capillary-type cold plate 70 of system 60. Cold plate 70 comprises a panel having elongated coextensive walls 68 and 72, end walls 74 and 76, and side walls 78 and 80 (see FIG. 2), defining an elongated vapor chamber 82. A wick 84 or a suitable layer of heat pipe wicking material is provided on the inside surfaces 86 and 88 of walls 68, 72 and 74. Outside surface 90 of wall 72 is used as a mounting surface upon which can be mounted heat-emitting equipment such as instruments 92 that it is desired to cool. A fitting 94 connects the vapor line 96 of system 60 with vapor port 98 in end wall 76 of the cold plate opening on vapor chamber 82.

With reference now to FIG. 2 which illustrates the heat transfer system 60 incorporating pump 10 of the invention; system 60 which is a two-phase system using heat pipe principles of operation includes a multiplicity of cold plates 70 mounting heat emitting instruments 92, a cold plate 100 mounted to a heat exchanger 101 connected into a second heat transfer loop 102, and a simple condensing heat exchanger 104 coupled to a radiator 106. Each of the cold plates 70 and 100 are provided with a pump 10 of the invention. The component of system 60 are connected in a parallel fluid circuit by means of the separate dedicated liquid line or tubing 58 and by the separate dedicated vapor line or tubing 96. System 60 is charged with an appropriate amount of a vaporizable heat pipe fluid to saturate the wicks 84 and to fill the liquid lines 58 and the volume of the pumps upstream of their porous exit membranes 28. As is well known, the working (heat pipe) fluid will be selected to meet the temperatures and operational requirements to be encountered in service. When in operation, a heat input into cold plates 70 from the heat emitting instruments 92 mounted thereon or from cold plate 100 from the second heat transfer loop 102 vaporizes the working liquid in the wick 84 therein, the resulting vapor circulating through vapor line 96 to a colder region of the loop, usually the heat exchanger 104 associated with radiator 106. Liquid resulting from the condensation of the vapor is circulated through liquid line 58 to the pumps 10 which are activated as required to replenish the liquid in the cold plates evaporated from the wicks. Temperature control of heat emitting instruments 92 is provided by a thermocouple or other suitable temperature sensing means 108 attached to the mounting surface 90 of the cold plate 70. Signals from the temperature sensing means 108 activate heater 42 of the pump 10 to initiate pumping action when its asociated cold plate 70 exceeds a set temperature.

Any suitable known electrical or electronic circuitry can be utilized to activate the heater in response to signals from the sensing means; for convenience, the sensing means is shown in circuit with a timer 110 for activating switch 50 and then deactivating it at the end of the desired heater pulse. Since a temperature rise in a cold plate is associated with a dryout of its wick, this requires the wick to operate in a partially desaturated mode. To maintain a minimum system temperature in a cold environment with the instrument 92 off and not emitting heat, the pump 10 of the heat exchanger 101 for the fluid line 112 of the second heat transfer loop 102 is activated whenever the vapor temperature falls below a set value. With this arrangement, the heat transfer loop fluid line 112 can be kept continuously open. This eliminates the need for a solenoid valve in the system since there will be no liquid to pick up heat by evaporation unless the associated pump 10 is activated. When heat is drawn from fluid line 112, one or more of the cold plates may operate as a condenser. With the pumps 10 of the invention in the system, this condition presents no problem since excess liquid in the cold plates 70 can flow back through the pump to the liquid line 58.

Similarly, if the second heat transfer loop 102 were to fall below the temperature of the vapor in line 96, cold plate 100 would operate as a condenser delivering heat to heat transfer fluid loop line 112.

In operation, the liquid line 58 and the pump jacket 52 and the volume of the pump 10 upstream of exit membrane 28 will be fitted with the liquid phase of the working fluid of the heat transfer loop 60. When the temperature of the associated cold plate 70 exceeds a predetermined temperature, a signal from the temperature sensing means 108 results in the heater 42 being turned on. A vapor bubble forms when the heater is turned on, raising the pressure within the pump volume 30. Although the vapor bubble is retained against the porous inlet membrane 26 by the baffle plate 32 the pores of the liquid saturated membrane are very small and have sufficient capillary pressure rise capability to prevent a vapor flow through the membrane. As the vapor bubble grows, the pressure in the pump volume 30 rises higher than the pressure downstream of the pump and liquid flows through the exit membrane 28. Eventually the vapor bubble will pass around the edges 36 of the baffle plate 32 and will substantially fill the pump volume. As the pump is located close to cold plate 10, most of the liquid delivered by the pump is captured by the cold plate wick 84.

The heat pulse is just long enough such that most of the liquid is expelled from the pump volume 30. When the heater 42 is turned off, the vapor bubble begins to condense due to the subcooled liquid in the cooling jacket 52 surrounding the pump chamber 20. As the bubble condenses, the pressure in the pump drops below the pressure of vapor chamber 82 of the cold plate 70. There is a small backflow of free liquid from the inlet 66 of the cold plate immediately downstream of the exit membrane 28, but there is no backflow from the cold plate wick 84 because there is no wick continuity between the exit membrane and the cold plate wick. As a result, vapor fills the region downstream of the exit membrane, but the liquid saturated membrane has sufficient capillary capability to prevent a flow of vapor through it. As the vapor bubble continues to condense, the pressure within the pump volume falls below the inlet pressure and the pump volume begins to refill with liquid entering through the inlet membrane. It will be recognized that, because the membranes are permeable to the liquid phase and not to the vapor phase of the fluid being pumped, they form passive check valves. Thus, they confine the vapor bubble in the pump volume during the pumping action and prevent a backflow of vapor when the vapor bubble is being condensed, but they do not provide any impediment to the required free flow of liquid. Because the liquid in the cooling jacket and that entering the pump volume is subcooled, after the heater is turned off the bubble in the pump volume is completely condensed, setting the stage for the entire cycle to repeat.

It is believed that an understanding of the method of the invention will be obtained from the preceding description of the construction and operation of capillary check valve pump 10. It will be appreciated that pump 10 thus is exemplary of the apparatus that can be used to practice the method for thermally pumping a volatile liquid.

Although shown and described in what are believed to be the most practical and preferred embodiments, it is apparent that deparatures from the specific methods and designs described and shown will suggest themselves to those skilled in the art and may be made without departing from the spirit and scope of the invention. I, therefore, do not wish to restrict myself to the particular constructions described and illustrated, but desire to avail myself of all modifications that may fall within the scope of the appended claims.

Having thus described my invention, what I claim is:

1. The method of thermally pumping a volatile fluid comprising the steps of:

admitting said fluid through a porous inlet capillary membrane into a closed pressure resistant housing having a pump volume defined by said inlet membrane and a porous exit capillary membrane to fill said pump volume with liquid, said membranes, when saturated with liquid, being permeable to only the liquid phase of said fluid;

applying a heat input into heating means in a baffle plate facing on and adjacent to said inlet membrane to form a vapor bubble which expels most of said liquid in said pump volume through said exit membrane;

terminating said heat input;

cooling said pump volume to condense said vapor bubble and thereby produce a drop in pressure which draws another charge of said liquid in through said inlet membrane to refill said pump volume; and applying a further heat input to repeat the pumping cycle.

2. A thermally actuated pump for delivering an evaporable working fluid comprising; a closed pressure resistant housing having an inlet port for admitting liquid thereinto and an exit port for exhausting liquid therefrom, a porous inlet capillary membrane disposed within said housing at the inlet port end thereof, a porous outlet capillary membrane disposed within said housing at the exit port end thereof, said membranes allowing the passage therethrough of only the liquid phase of said working fluid, said membranes defining a pump volume therebetween, a baffle plate having a substantially centrally located concavity therein positioned in said pump volume adjacent said inlet membrane with said concavity facing thereon, the peripheral edges of said plate being spaced from the inside surface of said housing to permit the passage of fluid therearound, heating means in said concavity, means for activating said heating means when at least said pump volume is full of liquid such that the heat input forms a vapor bubble centered in said concavity, the continued activation of said heating means causing said vapor bubble to grow to thereby expel through said exit membrane and exit port most of said liquid in said pump volume, cooling means surrounding at least said pump volume, whereby said vapor bubble is condensed when said heating means is de-activated, dropping the pressure in said pump volume to draw liquid in through said inlet port and membrane, recharging the pump volume prepartory to a further pumping cycle.

3. The thermally actuated pump defined in claim 2 wherein the porous membranes have a pore size in the range of 10 to 25 microns.

4. The thermally actuated pump defined in claim 2 wherein the heating means is an electrical heating element.

5. The thermally actuated pump defined in claim 2 wherein the cooling means is a jacket having fluid passages therein through which a coolant is circulated.

6. The thermally actuated pump defined in claim 5 wherein the coolant is the liquid being admitted into said pump.

* * * * *